US006052910A

United States Patent [19]

Kaebisch, Jr.

[11] Patent Number: 6,052,910

[45] Date of Patent: Apr. 25, 2000

[54] VEGETABLE CUTTING DEVICE

[76] Inventor: Jerald William Kaebisch, Jr., 5603 S. Indiana Ave., Cudahy, Wis. 53110-2435

[21] Appl. No.: 09/036,864

[22] Filed: Mar. 9, 1998

[51] Int. Cl.[7] ..... B26B 3/03

[52] U.S. Cl. ..... 30/316; 30/301; 99/537

[58] Field of Search ..... 30/316, 315; 241/168, 241/169; 99/537, 538

[56] References Cited

U.S. PATENT DOCUMENTS

| | | | |
|---|---|---|---|
| 1,977,017 | 10/1934 | Schiller | 30/316 |
| 2,019,009 | 10/1935 | Hendrix | 30/316 |
| 2,454,427 | 11/1948 | Bell | 30/316 |
| 3,043,207 | 7/1962 | Janus | 30/316 |
| 3,933,315 | 1/1976 | Popeil | 30/315 |
| 4,572,444 | 2/1986 | Shadduck | 30/316 |
| 4,789,555 | 12/1988 | Judd | 30/316 |
| 5,461,788 | 10/1995 | Taylor | 30/316 |

*Primary Examiner*—Rinaldi I. Rada
*Assistant Examiner*—Omar Flores-Sánchez

[57] ABSTRACT

A new vegetable cutting device for cutting lettuce and the like into shaped portions suitable for use with a variety of sandwich types. The inventive device includes a body member having a top portion, a bottom portion and a lateral portion, a slot formed in the lateral portion extending from the bottom portion and terminating proximate the top portion, a shaped cutting member having a hollow interior portion and a cutting blade disposed around a bottom periphery thereof, the cutting member being receivable within the body member and a plunger having a plate and a handle receivable through the slot, the handle being fixedly attached to a plate upper surface and the plate being receivable within the body member and engageable to a top periphery of the cutting member at a plate lower surface.

7 Claims, 3 Drawing Sheets

VEGETABLE CUTTING DEVICE

BACKGROUND OF THE INVENTION

1. Field of the Invention

The present invention relates to vegetable cutting devices and more particularly pertains to a new vegetable cutting device for cutting lettuce and the like into shaped portions suitable for use with a variety of sandwich types.

2. Description of the Prior Art

The use of vegetable cutting devices is known in the prior art. More specifically, vegetable cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art vegetable cutting devices include U.S. Pat. No. 2,473,165; U.S. Pat. No. 4,573,384; U.S. Pat. No. 4,955,271; and U.S. Pat. No. 5,271,317.

While these devices fulfill their respective, particular objectives and requirements, the aforementioned patents do not disclose a new vegetable cutting device. The inventive device includes a body member having a top portion, a bottom portion and a lateral portion, a slot formed in the lateral portion extending from the bottom portion and terminating proximate the top portion, a cutting member having a hollow interior portion and a cutting blade disposed around a bottom periphery thereof, the cutting member being receivable within the body member and a plunger having a plate and a handle receivable through the slot, the handle being fixedly attached to a plate upper surface and the plate being receivable within the body member and engageable to a top periphery of the cutting member at a plate lower surface.

In these respects, the vegetable cutting device according to the present invention substantially departs from the conventional concepts and designs of the prior art, and in so doing provides an apparatus primarily developed for the purpose of cutting lettuce and the like into shaped portions suitable for use with a variety of sandwich types.

SUMMARY OF THE INVENTION

In view of the foregoing disadvantages inherent in the known types of vegetable cutting devices now present in the prior art, the present invention provides a new vegetable cutting device construction wherein the same can be utilized for cutting lettuce and the like into shaped portions suitable for use with a variety of sandwich types.

The general purpose of the present invention, which will be described subsequently in greater detail, is to provide a new vegetable cutting device apparatus and method which has many of the advantages of the vegetable cutting devices mentioned heretofore and many novel features that result in a new vegetable cutting device which is not anticipated, rendered obvious, suggested, or even implied by any of the prior art vegetable cutting devices, either alone or in any combination thereof.

To attain this, the present invention generally comprises a body member having a top portion, a bottom portion and a lateral portion, a slot formed in the lateral portion extending from the bottom portion and terminating proximate the top portion, a cutting member having a hollow interior portion and a cutting blade disposed around a bottom periphery thereof, the cutting member being receivable within the body member and a plunger having a plate and a handle receivable through the slot, the handle being fixedly attached to a plate upper surface and the plate being receivable within the body member and engageable to a top periphery of the cutting member at a plate lower surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vegetable cutting device apparatus and method which has many of the advantages of the vegetable cutting devices mentioned heretofore and many novel features that result in a new vegetable cutting device which is not anticipated, rendered obvious, suggested, or even implied by any of the prior art vegetable cutting devices, either alone or in any combination thereof.

It is another object of the present invention to provide a new vegetable cutting device which may be easily and efficiently manufactured and marketed.

It is a further object of the present invention to provide a new vegetable cutting device which is of a durable and reliable construction.

An even further object of the present invention is to provide a new vegetable cutting device which is susceptible of a low cost of manufacture with regard to both materials and labor, and which accordingly is then susceptible of low prices of sale to the consuming public, thereby making such vegetable cutting device economically available to the buying public.

Still yet another object of the present invention is to provide a new vegetable cutting device which provides in the apparatuses and methods of the prior art some of the advantages thereof, while simultaneously overcoming some of the disadvantages normally associated therewith.

Still another object of the present invention is to provide a new vegetable cutting device for cutting lettuce and the like into shaped portions suitable for use with a variety of sandwich types.

Yet another object of the present invention is to provide a new vegetable cutting device which includes a body member having a top portion, a bottom portion and a lateral portion, a slot formed in the lateral portion extending from the bottom portion and terminating proximate the top portion, a cutting member having a hollow interior portion and a cutting blade disposed around a bottom periphery thereof, the cutting member being receivable within the body member and a plunger having a plate and a handle receivable through the slot, the handle being fixedly attached to a plate upper surface and the plate being receivable within the body member and engageable to a top periphery of the cutting member at a plate lower surface.

Still yet another object of the present invention is to provide a new vegetable cutting device that eliminates the need for using shredded lettuce on hamburgers and other sandwiches.

Even still another object of the present invention is to provide a new vegetable cutting device that provides for shaped cuts of lettuce and other vegetables, particularly cabbage, that conform to the shape of hamburger buns, sandwich bread loafs and other shapes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
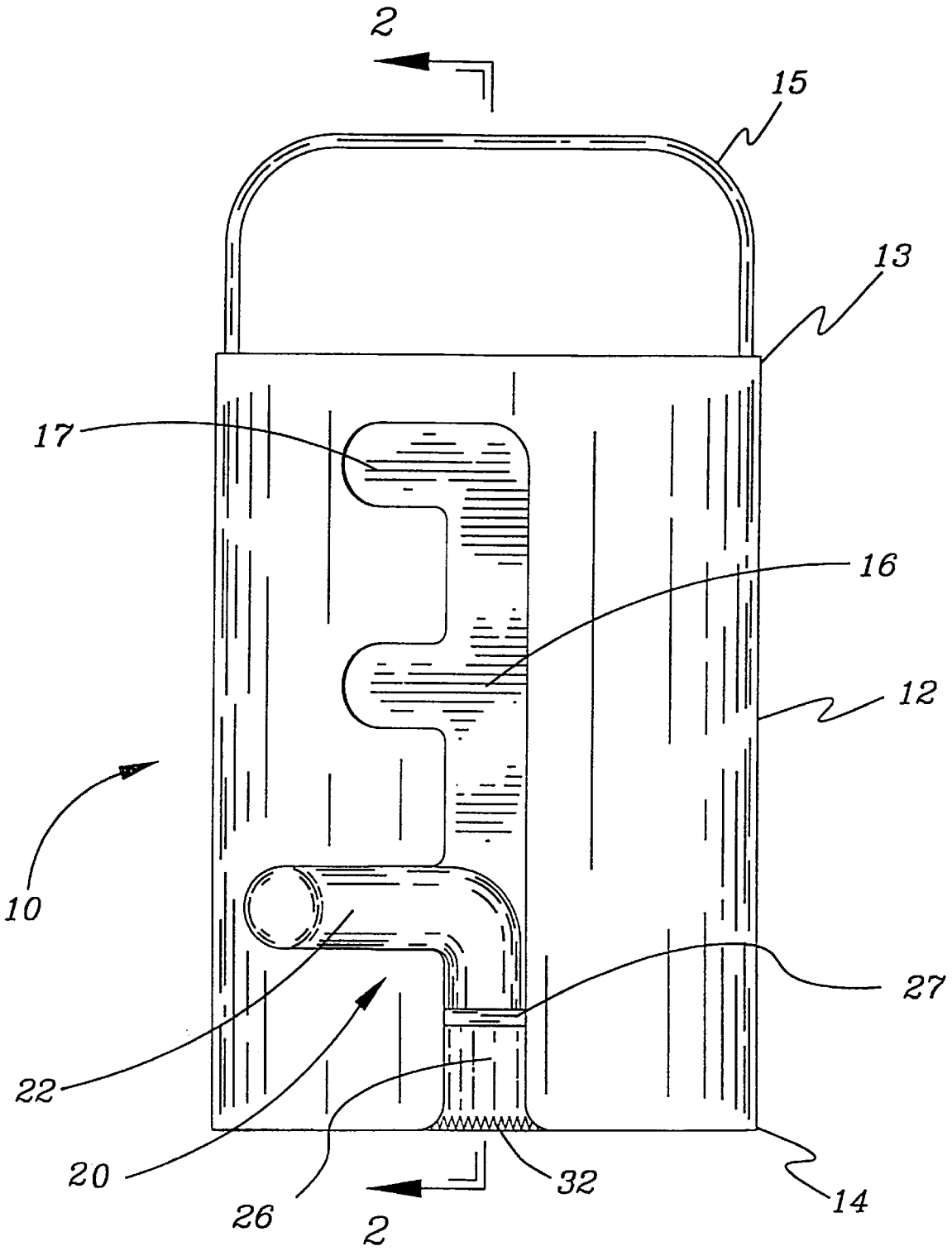
FIG. 1 is a side elevation view of a new vegetable cutting device according to the present invention.

With reference now to the drawings, and in particular to FIGS. 1 through 5 thereof, a new vegetable cutting device embodying the principles and concepts of the present invention and generally designated by the reference numeral 10 will be described.

Figure 2:
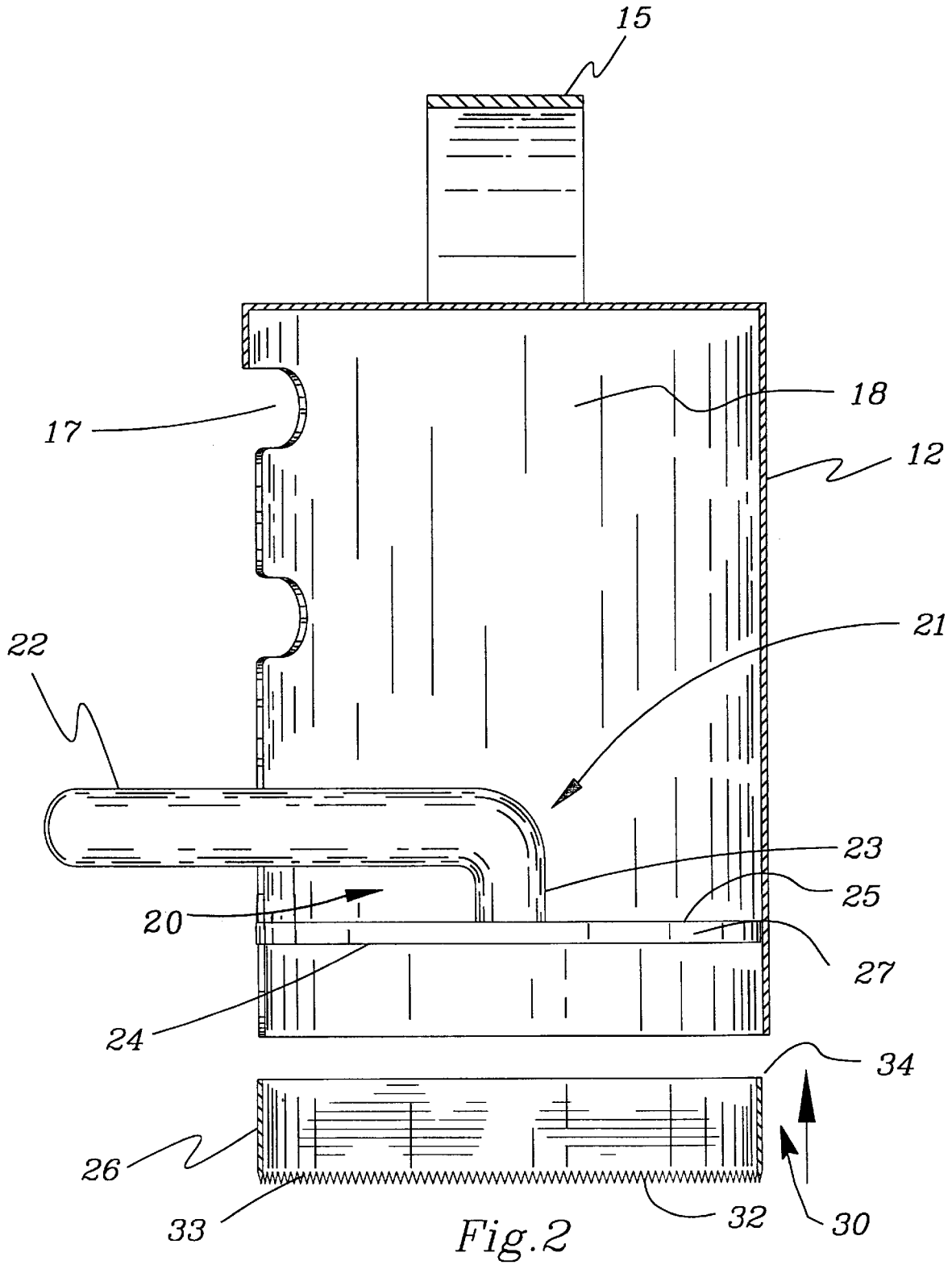
FIG. 2 is a cross sectional view taken along line 2—2 of FIG. 1.

With reference to FIGS. 1 and 2, it will be noted that the vegetable cutting device 10 comprises a hollow body member 12 of generally cylindrical cross section including a top portion 13, a bottom portion 14 and a lateral portion 18. A slot 16 is shown formed in the lateral portion 18 and is dimensioned to receive a handle 21 which is fixedly attached to a plate upper surface 25 of a plate 27, which in the preferred embodiment has a circular cross section and is dimensioned to slidingly fit within the body member 12. The slot 16 is shown extending from the bottom portion 14 and terminating proximate the top portion 13.

A plunger 20, including the plate 27, is shown receivable within the body member 12 for engagement to a cutting member top periphery 34 at a plate lower surface 24 when a cutting member 30 is similarly disposed within the body member 12 for cutting a quantity of vegetable by means of cutting blade 32, shown disposed around a bottom periphery 33.

With reference to FIGS. 1 through 5, the cutting member 30 is shown having a hollow interior portion 31 through which the shaped portions of the cut vegetable are allowed to pass when the vegetable cutting device 10 is in use. A side portion 26 is shown forming the body of the cutting member 30 and is sized to accommodate the bulk of the vegetable being cut. To accommodate the different sizes of the cutting members 30, positioning slots 17 are shown formed transversely from the slot 16 and similarly formed to receive the handle 20, which for ease of functionality is shown having a first section 22 and a second section 23 formed at a 90° relative to the first section 22 and fixedly attached to the plate upper surface 25. The cutting member 30 further is peripherally sized to allow for the excess vegetable cut from the shaped portions to reside within the body member 12.

A carrying handle 15 is shown fixedly attached to the top portion 13 for convenience in carrying the vegetable cutting device 10.

Figure 3:
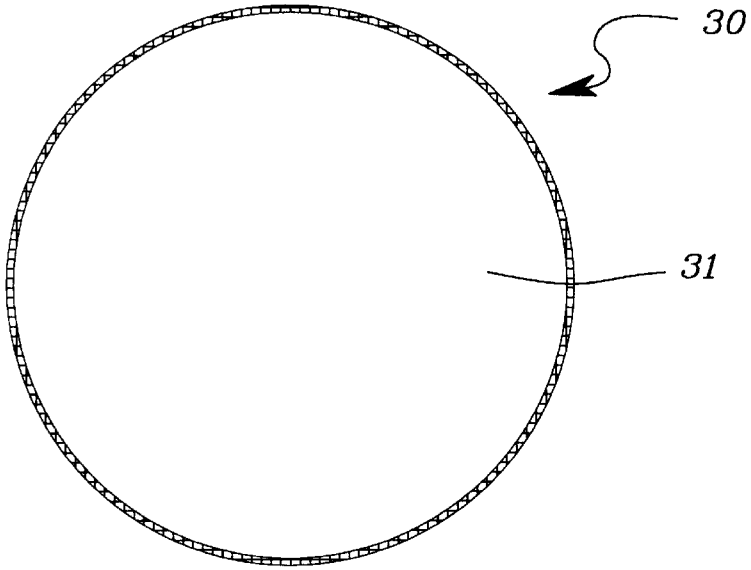
FIG. 3 is cross sectional view of the circular embodiment of the cutting member.
Figure 4:
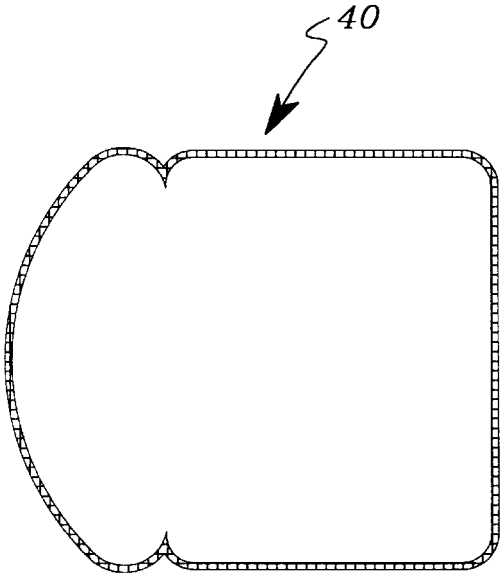
FIG. 4 is a cross sectional view of the sandwich bread loaf shaped cutting member.
Figure 5:
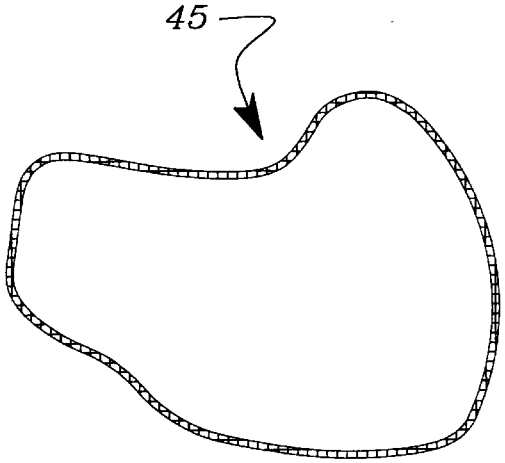
FIG. 5 is a cross sectional view of the irregularly shaped cutting member.

A shown in FIGS. 3 through 5, the cutting member 30 has a circular cross section and is suitable for cutting circular pieces of lettuce and the like for use with sandwiches made with generally circular buns. Alternatively the cutting member 40 is shown having a sandwich bread loaf cross section and is suitable for cutting sandwich bread loaf shaped pieces of lettuce and the like. Finally the cutting member 45 is shown having an irregular cross section.

In use, the desired cutting member 30, 40 or 45 is selected for use in cutting the desired vegetable. With the plunger 20 placed within the body member 12 and positioned by means of the positioning slots 17, the cutting member top periphery 34 is placed against the plate lower surface 24 and the vegetable is inserted into the bottom portion 14 of the body member 12. By placing the bottom portion 14 upon a flat cutting surface and exerting a downward force upon the handle 21, the cutting blade 32 cuts through the vegetable and produces the desired shape as the cutting member moves downwardly and the shaped vegetable moves through the hollow portion of the cutting member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vegetable cutting device comprising:

a body member having a top portion, a bottom portion and a lateral portion;

a slot formed in the lateral portion extending from the bottom portion and terminating proximate the top portion;

a cutting member having a hollow interior portion and a cutting blade disposed around a bottom periphery thereof, the cutting member being receivable within the body member; and a plunger having a plate and a handle receivable through the slot, the handle being fixedly attached to a plate upper surface and the plate being receivable within the body member and engageable to a top periphery of the cutting member at a plate lower surface.

2. The vegetable cutting device of claim 1, wherein the body member is cylindrical.

3. The vegetable cutting device of claim 2, wherein the plate has a circular horizontal cross section and is dimensioned to slidingly fit within the body member.

4. The vegetable cutting device of claim 1 further comprising a plurality of positioning slots formed transversely from the slot and formed to receive the handle.

5. The vegetable cutting device of claim 1 further comprising a carrying handle fixedly attached to the top portion.

6. The vegetable cutting device of claim 1, wherein the bottom periphery of the cutting member has a circular shape.

7. The vegetable cutting device of claim 1, wherein the bottom periphery of the cutting member has the shape of a vertical cross section of a sandwich loaf.

* * * * *